US006054968A

United States Patent [19]

De Matteo

[11] Patent Number: 6,054,968

[45] Date of Patent: Apr. 25, 2000

[54] MODULAR GRAPHICS DISPLAY

[76] Inventor: Keith De Matteo, 18402 Grange, Riverview, Mich. 48192

[21] Appl. No.: 08/977,429

[22] Filed: Nov. 24, 1997

[51] Int. Cl.[7] ..... G09F 7/00

[52] U.S. Cl. ..... 345/1; 40/605; 40/730; 345/903

[58] Field of Search ..... 248/129, 917, 248/919–923, 925; 345/23, 24, 33, 30, 31, 903, 1; 348/839, 840, 36; 40/605, 730, 606

[56] References Cited

U.S. PATENT DOCUMENTS

| | | | |
|---|---|---|---|
| D. 295,698 | 5/1988 | Komamura | D6/300 |
| 2,064,056 | 12/1936 | Cookson | 211/148 |
| 3,722,122 | 3/1973 | Sesto | 40/152 |
| 4,017,989 | 4/1977 | Murray | 40/605 |
| 4,128,286 | 12/1978 | Windisch et al. | 312/234 |
| 4,785,565 | 11/1988 | Kuffner | 40/605 |
| 5,299,017 | 3/1994 | Furuno | 348/786 |
| 5,323,552 | 6/1994 | Fritz | 40/776 |
| 5,544,436 | 8/1996 | Lefkowitz | 40/124.2 |
| 5,600,910 | 2/1997 | Blackburn | 40/605 |

*Primary Examiner*—Amare Mengistu
*Assistant Examiner*—Mansour M. Said
*Attorney, Agent, or Firm*—Harness, Dickey & Pierce, P.L.C.

[57] ABSTRACT

The present invention provides a modular graphics display assembly for supporting and displaying a plurality of art works in a myriad of orientations. Preferrably, the modular graphics display assembly includes a plurality of display bases for supporting a plurality of art works. An anchoring mechanism such as a flange having a plurality of apertures formed therethrough is coupled about a perimeter of each display base. A plurality of retention members such as fasteners having a number of posts extending therefrom are removably secured to selected anchoring mechanisms such that adjacent display bases are coupled together. Preferably, the anchoring mechanisms are uniformally arranged about the display bases such that the display bases may be arranged and rearranged into a variety of configurations.

20 Claims, 6 Drawing Sheets

MODULAR GRAPHICS DISPLAY

BACKGROUND OF THE INVENTION

1. Technical Field

The present invention generally relates to art display apparatus and, more particularly, to a modular graphics display for supporting and displaying a number of complimentary pieces of art work in a number of configurations.

2. Discussion

Modern art is becoming more and more graphic in nature often consisting of various geometric figures rather than of a scene. As such, the top, bottom, left and right sides of the art work have become more abstract. Advantageously, these types of art works can be displayed in any number of orientations to enhance and vary their appearance. However, there is no convenient way for suspending each art work in its many orientations.

Another modern trend in the art world is to combine a number of discrete art works into a single display. To accomplish this, a number of individually framed art works are suspended on a wall or the like adjacent to one another so as to yield a single display. Often, the image of one art work continues on an adjacent art work. However, there is no means for easily aligning adjacent art works together so that they compliment one another.

In view of the foregoing, there is a need to provide an apparatus for conveniently displaying a number of art works as a single unit which avoids the difficultly associated with aligning separate pieces on a wall or the like. Furthermore, there is a need to provide an apparatus for displaying a number of art works in a variety of interchangeable orientations so as to provide a variable configuration for the combined display.

SUMMARY OF THE INVENTION

The above and other objects are provided by a modular graphics display assembly for supporting and displaying a plurality of art works in a myriad of orientations. Preferrably, the modular graphics display assembly includes a plurality of display bases for supporting a plurality of art works. An anchoring mechanism such as a flange having a plurality of apertures formed therethrough is coupled about a perimeter of each display base. A plurality of retention members such as fasteners having a number of posts extending therefrom are removably secured to selected anchoring mechanisms such that adjacent display bases are coupled together. Preferably, the anchoring mechanisms are uniformally arranged about the display bases such that the display bases may be arranged and rearranged into a variety of configurations.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed towards a novel modular graphics display assembly for use in supporting and displaying a number of art works in a myriad of configurations. According to the present invention, a plurality of display members support a plurality of art works. Each of the display members includes an anchoring mechanism for cooperating with an anchoring mechanism of an adjacent display member. A plurality of retention members removably engage selected anchoring mechanisms such that adjacent display members are secured together. By removing and replacing retention members to various anchoring locations, the display bases can be arranged and rearranged into more than one orientation. As such, the combination of a number of art works can be displayed in a variety of configurations.

Figure 1:
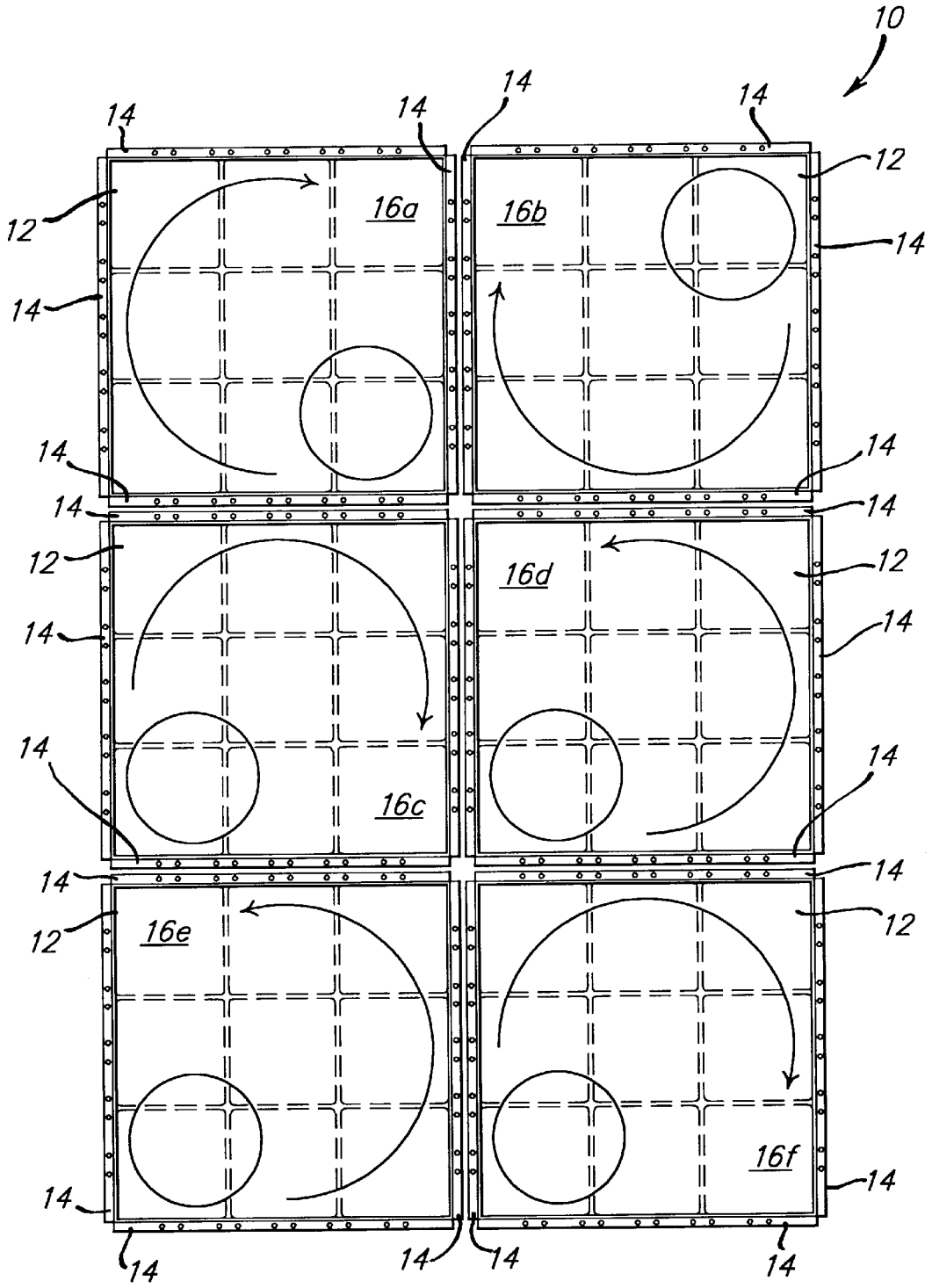
FIG. 1 is a front schematic view of a modular graphics display assembly including a plurality of display members in a representative arrangement supporting a plurality of artworks in accordance with the teachings of the present invention.
Figure 2:
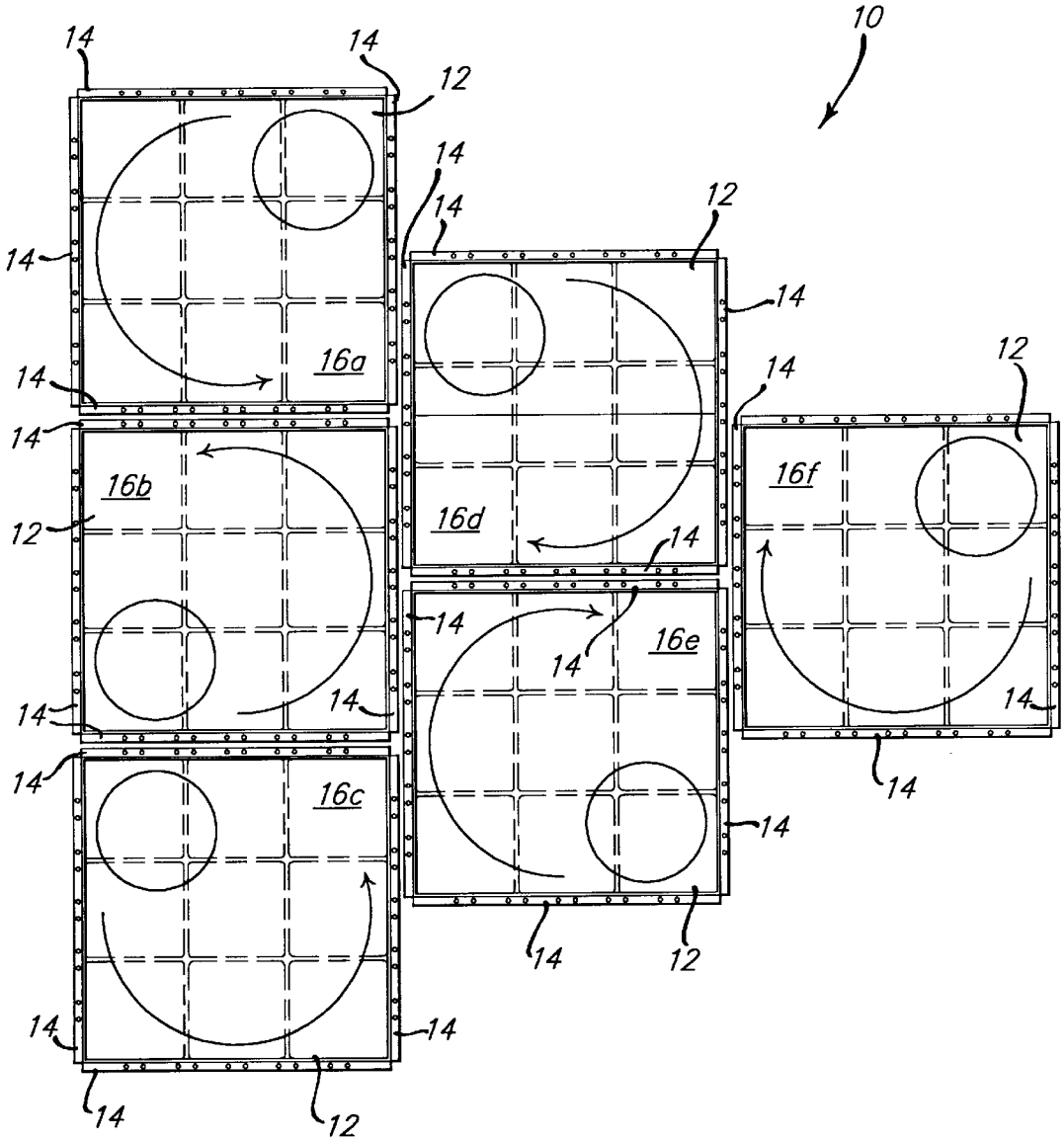
FIG. 2 is a front schematic view of the modular graphics display assembly of FIG. 1 wherein select display members have been rearranged to reconfigure the artworks in accordance with the teachings of the present invention.

Turning now to the drawing figures, a modular graphics display assembly 10 in accordance with the teachings of the present invention is illustrated in FIGS. 1 and 2. The display assembly 10 includes a plurality of adjacently arranged, square shaped, display members or bases 12. An anchoring or securing mechanism 14 is provided on each display base 12 for cooperating with an anchoring mechanism 14 on an adjacent display base 12. A plurality of retention members (described below) engage selected anchoring mechanisms 14 to removably secure adjacent display bases 12 together. According to this arrangement, a plurality of discrete art works 16*a*–16*f* supported by the plurality of display bases 12 through conventional means such as adhesive or the like can be displayed as a single unit and are capable of being rearranged into a number of configurations.

As illustrated in FIGS. 1 and 2, the present invention enables the plurality of display bases 12 to be rearranged and interconnected so as to vary the combined configuration of the art works 16*a*–16*f*. Also, individual art works 16*a*–16*f* can be reoriented with respect to an adjacent art work 16*a*–16*f*. Also, independent display bases 12 may be moved within the display assembly 10 to yield yet another configuration for the combined unit. It should also be noted that although a single art work design is illustrated throughout the display assembly 10, any number of art designs may be incorporated therein. Additionally, the configurations illustrated in FIGS. 1 and 2 are merely exemplary of possible displays and any number of variations thereof are possible and within the scope of the present invention.

Figure 3:
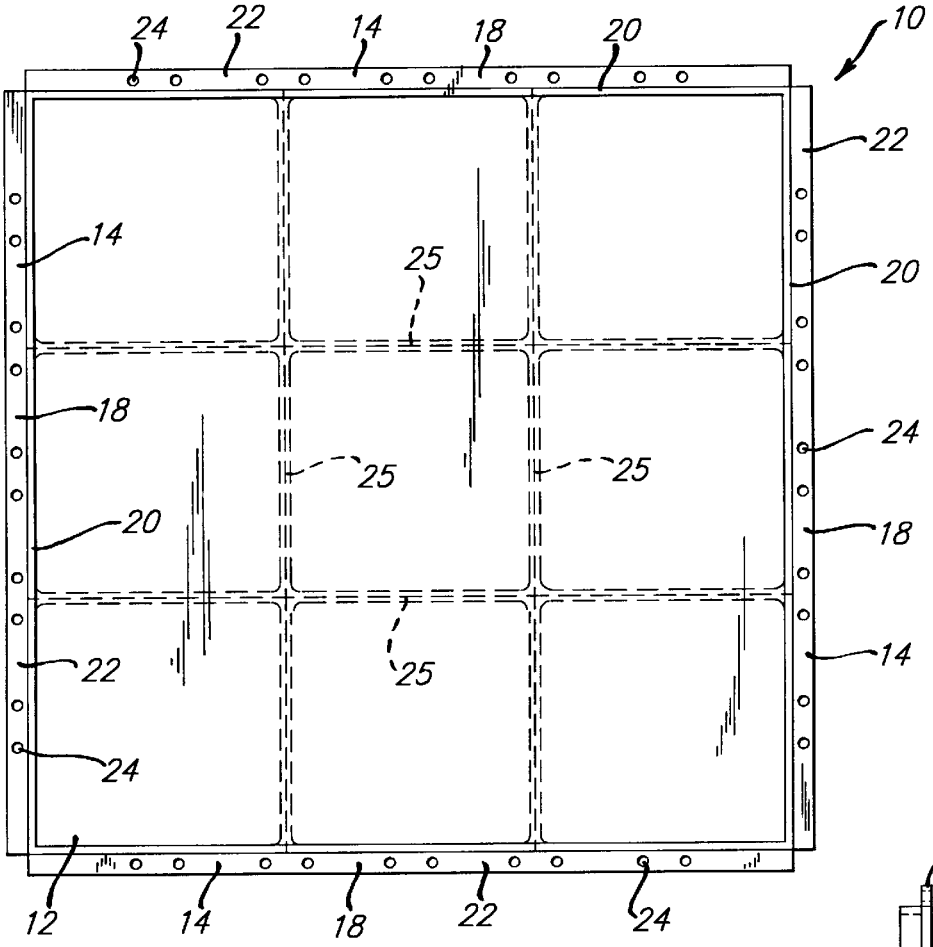
FIG. 3 is a front schematic view of a base member of the modular graphics display assembly of FIGS. 1 and 2.
Figure 4:
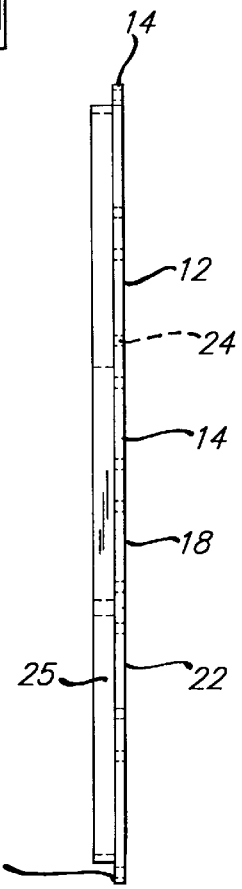
FIG. 4 is a side schematic view of the modular graphics display member of FIG. 3.
Figure 5:
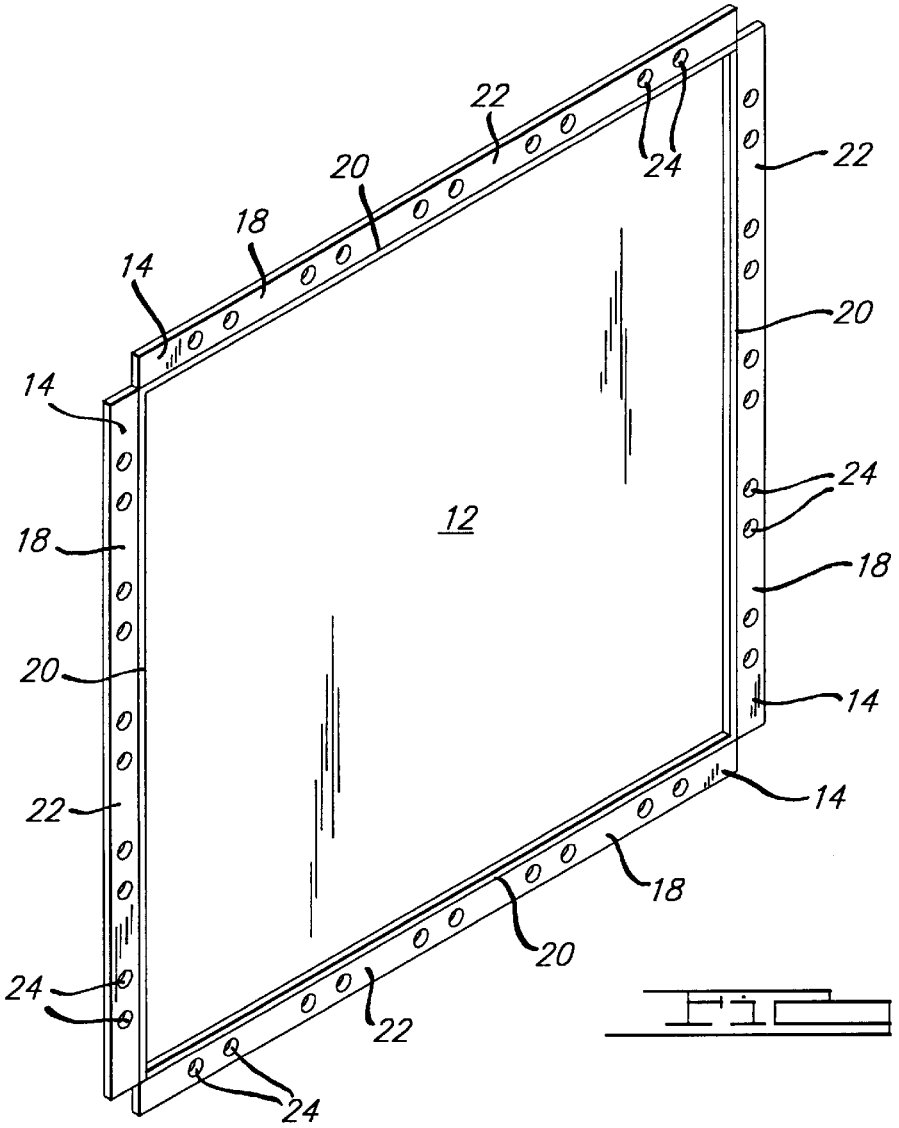
FIG. 5 is a perspective view of a base member of the modular graphics display assembly of the present invention illustrating an anchoring mechanism in greater detail.

Turning now to FIGS. 3–5, a single display base 12 is illustrated in greater detail. The display base 12 is illustrated as being generally square shaped, but may be any shape suitable for supporting a desired art work to be displayed such as but not limited to rectangular, trapezoidal, polygonal, etc. so long as the sides of adjacent display bases 12 are complimentary. The art work may be supported on the face of the display base 12 by any conventional means such as adhesive, tacks, brackets, etc. Furthermore, the display base 12 may include a wire or other hanging means on a surface thereof to enable it to be suspended from a wall or the like. On the other hand, display base may simply be supported on an easel. Plastic and aluminum display bases have been found preferable but other materials could substitute therefore.

The display base 12 includes an anchoring mechanism 14 which consists of four rectangularly shaped securing members 18 coupled about a perimeter 20 of the display base 12 so as to project from each edge thereof. More particularly, each securing member 18 includes an elongated, rectangular metal or plastic flange 22 laterally projecting from an edge of the perimeter 20 of the display base 12. The flange 22 includes a plurality of apertures 24 formed therethrough for cooperating with apertures 24 of an adjacent display base 12. Preferrably, the apertures 24 are uniformly arranged about the perimeter 20 of the display base 12 so that they compliment adjacent apertures 24 irrespective of the orientation of each display base 12. Even more preferrably, the apertures 24 are arranged as a sequence of consecutive pairs of apertures 24 formed in spaced apart relation along the length of each flange 22. As such, each pair of apertures 24 cooperates with an adjacent pair of apertures 24 of another display base 12.

Also, the display base 12 includes a plurality of ribs 25 extending between the edges of the perimeter 20 to ridigly support the base 12. Although only one display base 12 is illustrated in detail in FIGS. 3–5, it is to be understood that the remaining display bases 12 illustrated in FIGS. 1 and 2 include an anchoring mechanism 14 having securing members 18 which are complementary of the anchoring mechanisms 14 of other display bases 12. In this way, adjacent display bases 12 can be secured together in a variety of configurations regardless of the particular orientation of an individual display base 12.

Figure 6:
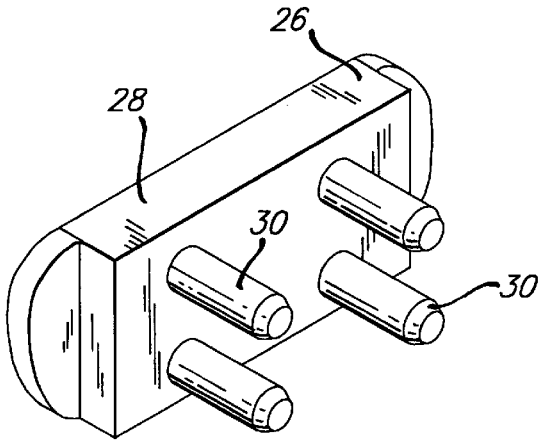
FIG. 6 is a perspective view of a retention member for interconnecting pairs of display members of the modular graphics display assembly of the present invention.
Figure 7A:
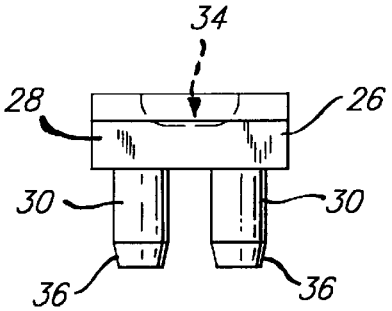
FIGS. 7*a*–7*e* illustrate the retention member of FIG. 6 in a variety of views.
Figure 7B:
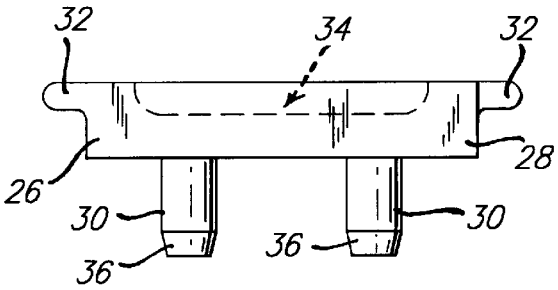
Figure 7C:
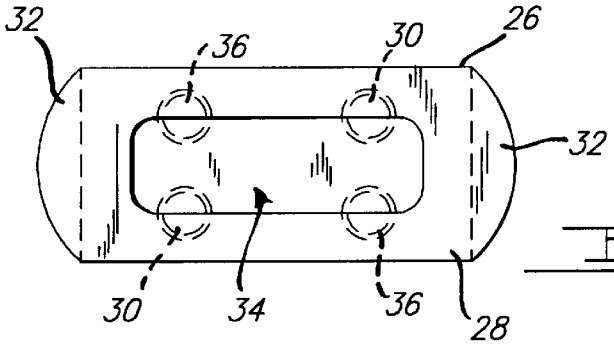
Figure 7D:
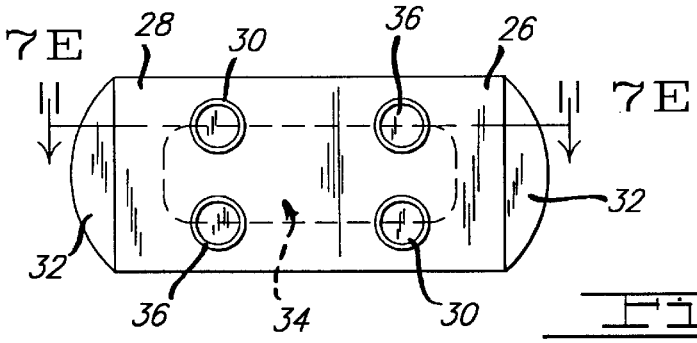
Figure 7E:
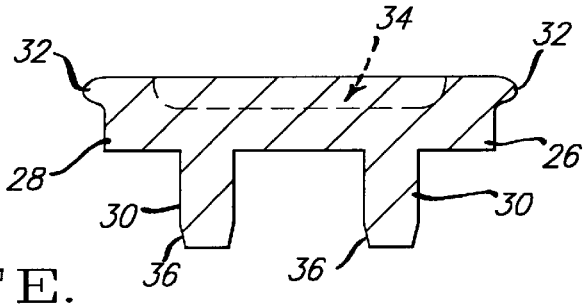

Turning now also to FIG. 6, a retention member 26 for interconnecting adjacent display bases 12 via the anchoring mechanisms 14 will be described in greater detail. The retention member 26 is preferably molded plastic and includes a generally rectangularly shaped base 28 having a plurality of cylindrically shaped posts or dowels 30 outwardly projecting therefrom. The posts 30 are adapted for engaging a first set of apertures 24 in a first securing member 18 or flange 22 of a first display base 12 and simultaneously engaging a second set of apertures 24 in a second securing member 18 or flange 22 of a second display base 12 so as to secure the first and second display bases 12 together. Preferably, a pair of posts 30 are dedicated to each of the first and second display bases 12 for firmly securing the two display bases 12 together.

Turning now to FIGS. 7*a–7e,* the retention member 26 is illustrated in greater detail. The retention member 26 includes a pair of partially circular projections 32 laterally extending from opposite ends of the base 28 at an upper portion thereof. The projections 32 provide a gripping surface for an operator to grasp when removing the retention member 26 from the anchoring mechanisms 14 (see FIG. 5). The retention member 26 also includes a cavity or recess 34 formed in an upper surface of the base 28. The recess 34 provides a convenient location for an operator's thumb when grasping a projection 32 with an index finger. The combination of the projections 32 and recess 34 provide a leveraging means for yielding a mechanical advantage when removing the retention member 26 from the anchoring mechanisms 14. Furthermore, the posts 30 include a tapered end 36 for guiding the entry of posts 30 into apertures 24 of flange 22 (see FIG. 5) such that engagement of retention members 26 with anchoring mechanisms 14 is facilitated.

Figure 8:
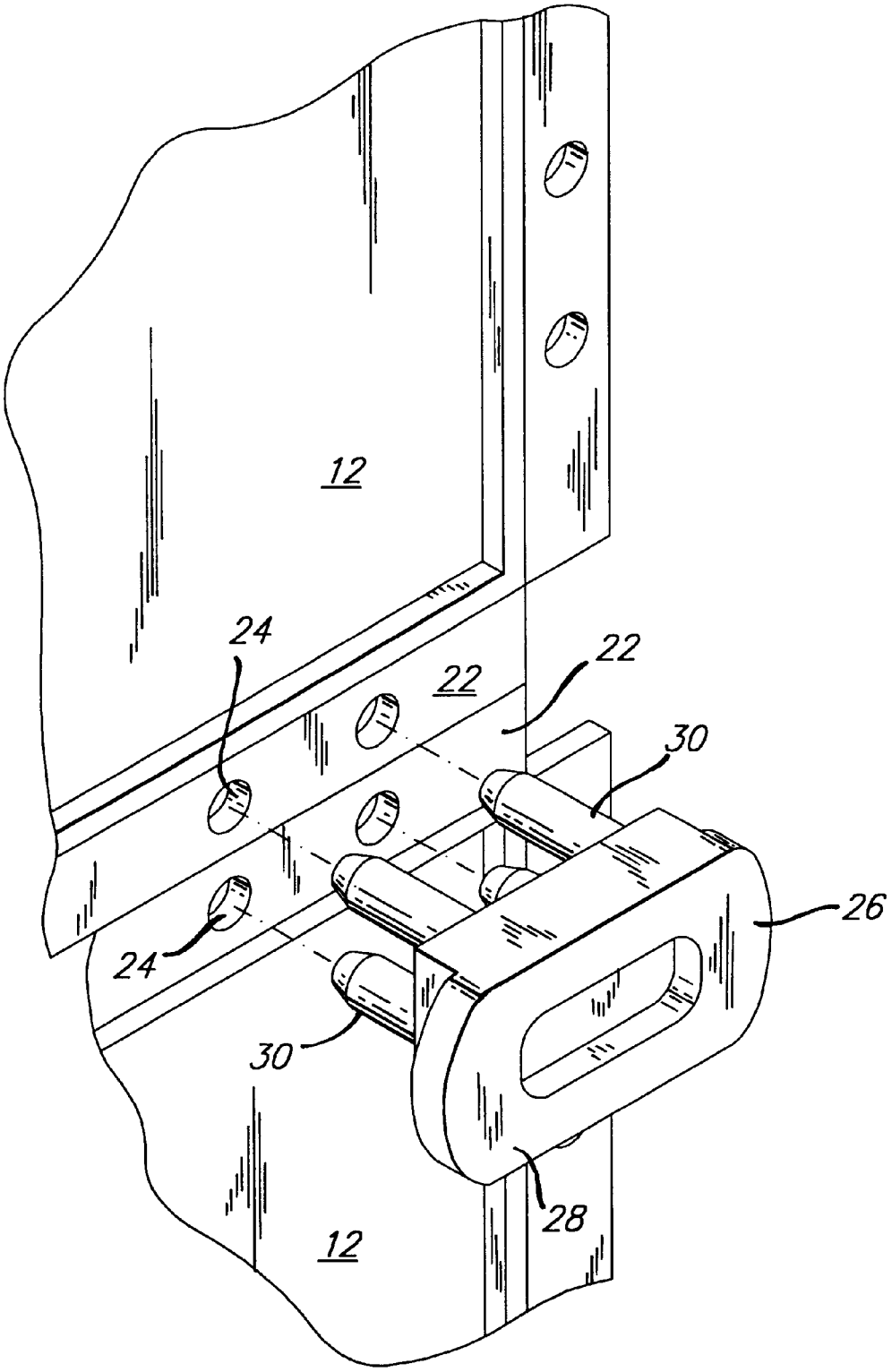
FIG. 8 is a perspective view of a portion of the modular graphics display of the present invention illustrating the operation of a retention member.

Referring now to FIG. 8, a pair of display bases 12 are illustrated adjacent one another. In addition, a retention member 26 is illustrated aligned with apertures 24 in flanges 22 immediately prior to engagement thereof. As can be appreciated, the lengthwise dimension between posts 30 relative to base 28 is selected to compliment the spacing of consecutive apertures 24 along flange 22. Similarly, the crosswise dimension of posts 30 is selected to compliment the spacing of adjacent apertures 24 of appropriately aligned pairs of display bases 12. As such, the retention member 26 secures adjacent pairs of display bases 12 together by simultaneously engaging a first set of apertures 24 in a first display base 12 and a second set of apertures 24 in a second display base 12. It should be appreciated that it is preferred to employ a plurality of retention members 26 for securing adjacent display bases 12 together.

Referring now generally to all of the figures, in operation, the modular graphics display assembly 10 of the present invention enables a plurality of display bases 12 to be arranged and rearranged into a variety of configurations through the cooperation of a plurality of removable retention members 26 with the anchoring mechanisms 14 of a plurality of display bases 12. More particularly, a first set of posts of at least one retention member 26 removably engage a first set of apertures 24 in a first flange 22 of a first display base 12. A second set of posts 30 of the same retention member 26 simultaneously removably engage a second set of apertures 24 in a second flange 22 of a second display base 12. As such, the first display base 12 and second display base 12 are secured together. To re-configure the display assembly 10, the retention members 26 securing one display base 12 to other display bases 12 are removed and one or more of the display bases 12 are re-oriented relative to the other display bases 12. Subsequently, the retention members 26 are reinserted within the anchoring mechanisms 14. As can be understood, more than one display base 12 may be moved and at any one time to yield a number of possible combinations for the display assembly 10.

Those skilled in the art can now appreciate from the foregoing description that the broad teachings of the present invention can be implemented in a variety of forms. For example, any number of posts can be provided on each retention member for cooperating with an equal number of apertures formed in the flanges of the display bases. Likewise, the particular configuration of the retention member can be selected so as to yield a desired profile for interconnecting adjacent display bases. Therefore, while this invention has been described in connection with particular examples thereof, the true scope of the invention should not be so limited since other modifications will become apparent to the skilled practitioner upon a study of the drawings, specification, and following claims.

What is claimed is:

1. A modular graphics display assembly comprising:

a plurality of display members, each of said display members having a flange laterally extending about a perimeter thereof for cooperating with a flange of an adjacent display member, said flange including a plurality of apertures formed therethrough; and a plurality of retention members including a first pair of posts extending therefrom for removably engaging a first pair of apertures of a first flange of a first display member and a second pair of posts extending therefrom in spaced relation to said first pair of posts for removably engaging a second pair of apertures of a second flange of a second display member such that said plurality of display members may be arranged and rearranged into more than one orientation relative to one another.

2. The modular graphics display assembly of claim 1 wherein said apertures are uniformly distributed about said perimeter of said display members.

3. The modular graphics display of claim 2 wherein said apertures are distributed in a sequence of consecutive pairs of apertures disposed in spaced apart relation along said flange.

4. The modular graphics display of claim 1 wherein said retention members further comprise a base including a leveraging member for providing a mechanical advantage when removing said retention members from said apertures.

5. The modular graphics display of claim 4 wherein said leveraging member further comprises a graspable projection laterally extending away from said base.

6. The modular graphics display of claim 5 wherein said leveraging member further comprises a recess formed in said base in spaced relation to said graspable projection.

7. A modular graphics display for displaying a plurality of art works in a myriad of orientations comprising:

at least two display bases for supporting said plurality of art works;

a flange laterally extending about a perimeter of each of said display bases, said flange including a plurality of apertures formed therethrough; and a plurality of fasteners for selectively securing said display bases together, each of said fasteners including a first pair of posts for removably engaging a first pair of apertures of a first of said display bases and a second pair of posts for removably engaging a second pair of apertures of a second of said display bases such that said display bases may be removably interconnected in a variety of configurations relative to one another.

8. The modular graphics display of claim 7 wherein said plurality of apertures are uniformly arranged along said flange about said perimeter of said bases.

9. The modular graphics display of claim 8 wherein said uniform arrangement of said apertures further comprises a sequence of consecutive pairs of apertures disposed in spaced apart relation along said flange.

10. The modular graphics display of claim 7 wherein said fasteners further comprise a base including a leveraging member for providing a mechanical advantage when removing said fastener from said apertures.

11. The modular graphics display of claim 10 wherein said leveraging member further comprises a graspable projection laterally extending away from said base.

12. The modular graphics display of claim 11 wherein said graspable projection includes a circularly shaped edge.

13. The modular graphics display of claim 11 wherein said leveraging member further comprises a recess formed in said base in spaced relation to said graspable projection.

14. A modular graphics display for supporting and displaying a plurality of complimentary art pieces in a number of assemblages so as to provide a changeable appearance for the combination of said art pieces comprising:

a plurality of bases for supporting said plurality of art pieces;

a flange laterally projecting about a perimeter of each of said bases;

a plurality of apertures formed in said flange; and a plurality of fasteners including a first and second pair of posts projecting therefrom for removably engaging selected members of said plurality of apertures, said members including at least a first pair of apertures formed in a first flange of a first of said plurality of bases and a second pair of apertures formed in a second flange of a second of said plurality of bases so as to removably secure said first and second bases together in one of said number of assemblages.

15. The modular graphics display of claim 14 wherein said plurality of apertures are uniformly arranged along said flange about said perimeter of said bases.

16. The modular graphics display of claim 15 wherein said uniform arrangement of said apertures further comprises a sequence of consecutive pairs of apertures disposed in spaced apart relation along said flange.

17. The modular graphics display of claim 14 wherein said fasteners further comprise a base including a leveraging member for providing a mechanical advantage when removing said fastener from said apertures.

18. The modular graphics display of claim 17 wherein said leveraging member further comprises a graspable projection laterally extending away from said base.

19. The modular graphics display of claim 18 wherein said graspable projection includes a circularly shaped edge.

20. The modular graphics display of claim 18 wherein said leveraging member further comprises a recess formed in said base in spaced relation to said graspable projection.

* * * * *